US010814363B2

(12) United States Patent
Bowman

(10) Patent No.: US 10,814,363 B2
(45) Date of Patent: Oct. 27, 2020

(54) DRINKING STRAW SANITIZER

(71) Applicant: John Jay Bowman, Deerfield Beach, FL (US)

(72) Inventor: John Jay Bowman, Deerfield Beach, FL (US)

( * ) Notice: Subject to any disclaimer, the term of this patent is extended or adjusted under 35 U.S.C. 154(b) by 0 days.

(21) Appl. No.: 16/532,841

(22) Filed: Aug. 6, 2019

(65) Prior Publication Data

US 2020/0086363 A1 Mar. 19, 2020

Related U.S. Application Data

(60) Provisional application No. 62/731,678, filed on Sep. 14, 2018.

(51) Int. Cl.

| | |
|---|---|
| ***B08B 9/032*** | (2006.01) |
| ***B08B 3/10*** | (2006.01) |
| *A47G 21/18* | (2006.01) |

(52) U.S. Cl.

CPC ..... *B08B 9/0323* (2013.01); *B08B 3/106* (2013.01); *A47G 21/18* (2013.01)

(58) Field of Classification Search

None

See application file for complete search history.

(56) References Cited

U.S. PATENT DOCUMENTS

| | | | | |
|---|---|---|---|---|
| 2004/0129299 | A1* | 7/2004 | Kocherlakota | B08B 9/0323 134/56 R |
| 2010/0071724 | A1* | 3/2010 | Baumgartner | A61L 2/18 134/23 |
| 2012/0291827 | A1* | 11/2012 | Buddharaju | A47L 15/428 134/198 |
| 2015/0352605 | A1* | 12/2015 | Tiwari | A61M 1/06 134/105 |
| 2016/0101423 | A1* | 4/2016 | Smith | B08B 9/0323 134/21 |
| 2017/0216890 | A1* | 8/2017 | seltz | B08B 9/0436 |
| 2018/0168428 | A1* | 6/2018 | Wilson | A47L 15/505 |

* cited by examiner

*Primary Examiner* — Cristi J Tate-Sims

(74) *Attorney, Agent, or Firm* — Lamon Patent Services; Cynthia S. Lamon

(57) ABSTRACT

An apparatus for cleaning drinking straws has a canister enclosing a plurality of carriers for supporting drinking straws to be cleaned, and a subsystem supplying water heated to a sanitizing temperature to the carriers. Straws are placed in or on the carriers, and the heated water flows around the inside and the outside of the straws.

10 Claims, 8 Drawing Sheets

DRINKING STRAW SANITIZER

CROSS-REFERENCE TO RELATED APPLICATIONS

The present invention claims priority to U.S. Provisional application 62/731,678, filed Sep. 14, 2018, and all disclosure of the parent case is incorporated at least by reference.

BACKGROUND OF THE INVENTION

1. Field of the Invention

The present invention is in the technical area of cleaning and sanitizing apparatus and methods, and pertains more particularly to methods and apparatus for cleaning and sanitizing durable drinking straws.

2. Description of Related Art

It is well-known that disposable drinking straws are an item of substantial waste in commerce in the US and other countries as well. Americans use approximately 500 million disposable or single use straws per day, and discarded drinking straws are one of the top five common forms of trash picked up from coastlines in this country.

What is clearly needed is an apparatus and methods to clean and sanitize drinking straws that might otherwise be discarded and end up in the world's oceans causing harm to marine animals' ecosystems, and having a severe, negative impact on the environment.

BRIEF SUMMARY OF THE INVENTION

In one embodiment of the invention an apparatus for cleaning durable drinking straws is provided, comprising, a canister enclosing a plurality of carriers for supporting drinking straws to be cleaned, and a subsystem supplying water heated to a sanitizing temperature to the carriers. Straws are placed in or on the carriers, and the heated water flows around the inside and the outside of the straws.

In one embodiment the carriers are upright tubes, each of a length and diameter to enclose a straw to be cleaned, and the heated water flows through the tubes immersing the straws. Also, in one embodiment the carriers are upright tubes of a diameter less than a diameter of straws to be cleaned, each upright tube having horizontally-directed openings, and wherein the straws to be cleaned are placed over the tubes and the heated water flows into the tubes and out through the horizontally-directed openings. In one embodiment the tubes are longer than the straws, such that heated water flowing out of the horizontally-directed openings above the tops of straws on the tubes is directed to the outside of straws on other tubes, both the inside and outside of the straws on the tubes being immersed in the heated water. And in one embodiment the apparatus further comprises one or more manifolds coupled to the carriers and a pump and heater implemented proximate the canister, such that heated water is pumped through the carriers and either directed to a drain or re-circulated to the pump and heater.

In one embodiment the apparatus further comprises an enclosure having physical interfaces for the manifolds to connect to the canister and carriers, and a door to the enclosure, such that canisters are removable and replaceable in the enclosure, straws being placed in or on the carriers outside the enclosure, and cleaning happening inside the enclosure. In one embodiment the canister is of cylindrical shape with a vertical axis and a circular cross-section, and a plurality of the carriers are arranged vertically within the circular cross-section. Also in one embodiment a first physical interface is a vertically-translatable nozzle apparatus having nozzles arranged to couple to the tubes at a top of the canister, and a second physical interface couples a base of the canister to a fluid conduit, wherein loading a canister involves lowering the nozzle apparatus, coupling nozzles to each of the tubes, such that heated water is pumped downward through the tubes, enveloping the straws in the tubes, and out through the fluid conduit at the base of the canister. In one embodiment the canister is of rectangular shape, and a plurality of the tubes are arranged vertically from the base in a Cartesian pattern. And in one embodiment, when the canister is loaded into the cleaning enclosure, the base of the canister is coupled to a fluid entrance conduit, such that heated water is pumped upward through the tubes, spraying water against the inside surfaces of the straws mounted over the tubes, and water is also sprayed above the straws onto the outside surfaces of the straws. In one embodiment the apparatus further comprises sanitizing additives in the heated water. And in one embodiment the apparatus comprises ultra violet (UV) irradiation apparatus and support apparatus for straws to be cleaned, wherein straws are placed on the support apparatus and irradiated by UV light before or after, or before and after being cleaned by heated water in the cleaning enclosure.

In another aspect of the invention a method for cleaning drinking straws is provided, comprising enclosing a plurality of carriers for supporting drinking straws to be cleaned in a canister, placing straws to be cleaned in or on the carriers, and supplying water heated to a sanitizing temperature to the carriers.

In one embodiment of the method the carriers are upright tubes, each of a length and diameter to enclose a straw to be cleaned, and the heated water is pumped through the tubes immersing the straws. Also in one embodiment the carriers are upright tubes of a diameter less than a diameter of straws to be cleaned, each upright tube having horizontally-directed openings, and the method comprises placing the straws to be cleaned over the tubes and flowing the heated water into the tubes and out through the horizontally-directed openings.

In one embodiment of the method the tubes are longer than the straws, and the method comprises flowing the heated water out of the horizontally-directed openings above the tops of straws on the tubes directed to the outside of straws on other tubes, both the inside and outside of the straws on the tubes being immersed in the heated water. Also, in one embodiment the method further comprises coupling one or more manifolds to the carriers and a flowing water by a pump through a heater, the pump and heater implemented proximate the canister, such that heated water is pumped through the carriers and either directed to a drain or re-circulated to the pump and heater. Also in one embodiment the method further comprises placing the canister, with straws to be cleaned, into an enclosure having physical interfaces for the manifolds to connect to the canister and carriers, closing a door to the enclosure, and activating the pump and heater to clean the straws.

In one embodiment the method further comprises arranging a plurality of carriers vertically within a circular cross section of a canister of cylindrical shape with a vertical axis. In one embodiment the method further comprises placing the canister into the enclosure into a first physical interface as a base having a fluid manifold, and lowering a vertically-translatable nozzle apparatus having nozzles arranged to couple to the tubes at a top of the canister, to couple to the carriers, and pumping heated water downward through the carriers, enveloping the straws, and out through the fluid manifold at the base of the canister. In one embodiment the canister is of rectangular shape, and a plurality of the carriers are arranged vertically from the base in a Cartesian pattern. And in one embodiment, when the canister is loaded into the cleaning enclosure, the base of the canister is coupled to a fluid entrance conduit, such that heated water is pumped upward through the tubes, spraying water against the inside surfaces of the straws mounted over the tubes, and water is also sprayed above the straws onto the outside surfaces of the straws.

In one embodiment of the method sanitizing materials are added to the heated water. And in one embodiment the straws are irradiated with ultra violet (UV) irradiation apparatus before or after being cleaned by heated water in the cleaning enclosure.

DETAILED DESCRIPTION OF THE INVENTION

Figure 1:
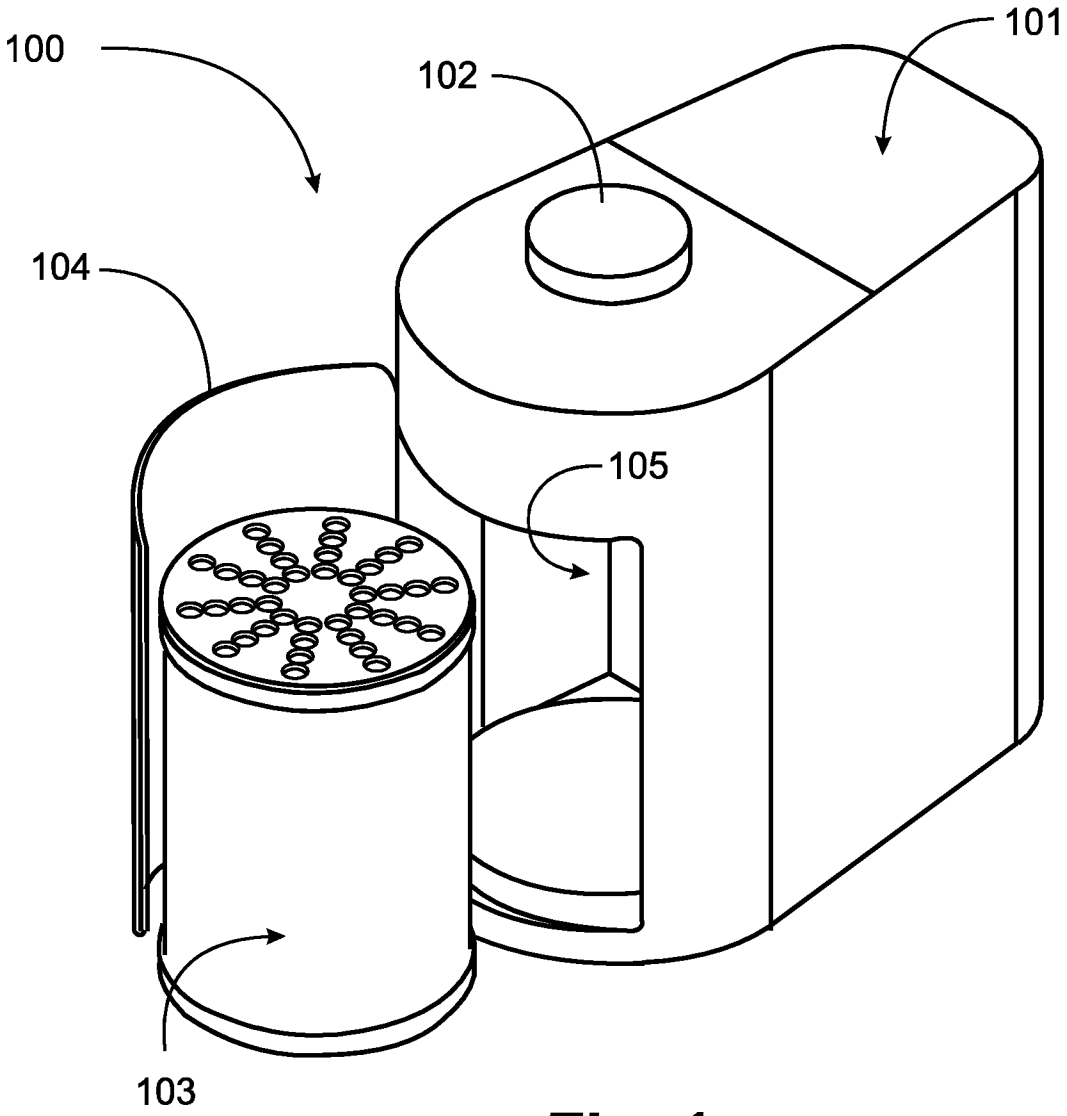
FIG. 1 is a perspective view of a straw cleaning and sanitizing apparatus in an embodiment of the present invention.

FIG. 1 is a perspective view of a straw cleaning and sanitizing apparatus 100 in an embodiment of the present invention. The apparatus has a cleaning enclosure 101 with a door 104 closing an opening 105 into the enclosure, and a canister 103 into which straws to be cleaned may be inserted in tubes for the purpose. The canister may then be placed in the enclosure, the door closed, and a locking nozzle apparatus 102 may be lowered and locked to connect cleaning fluid to the tubes in the canister, as is described in enabling detail below. The unit may then be activated to clean the straws that were placed in the tubes of the canister, after which door 104 may be opened, canister 103 removed, and the sanitized straws may be removed from the tubes in the canister. A new cycle may then commence.

Figure 2:
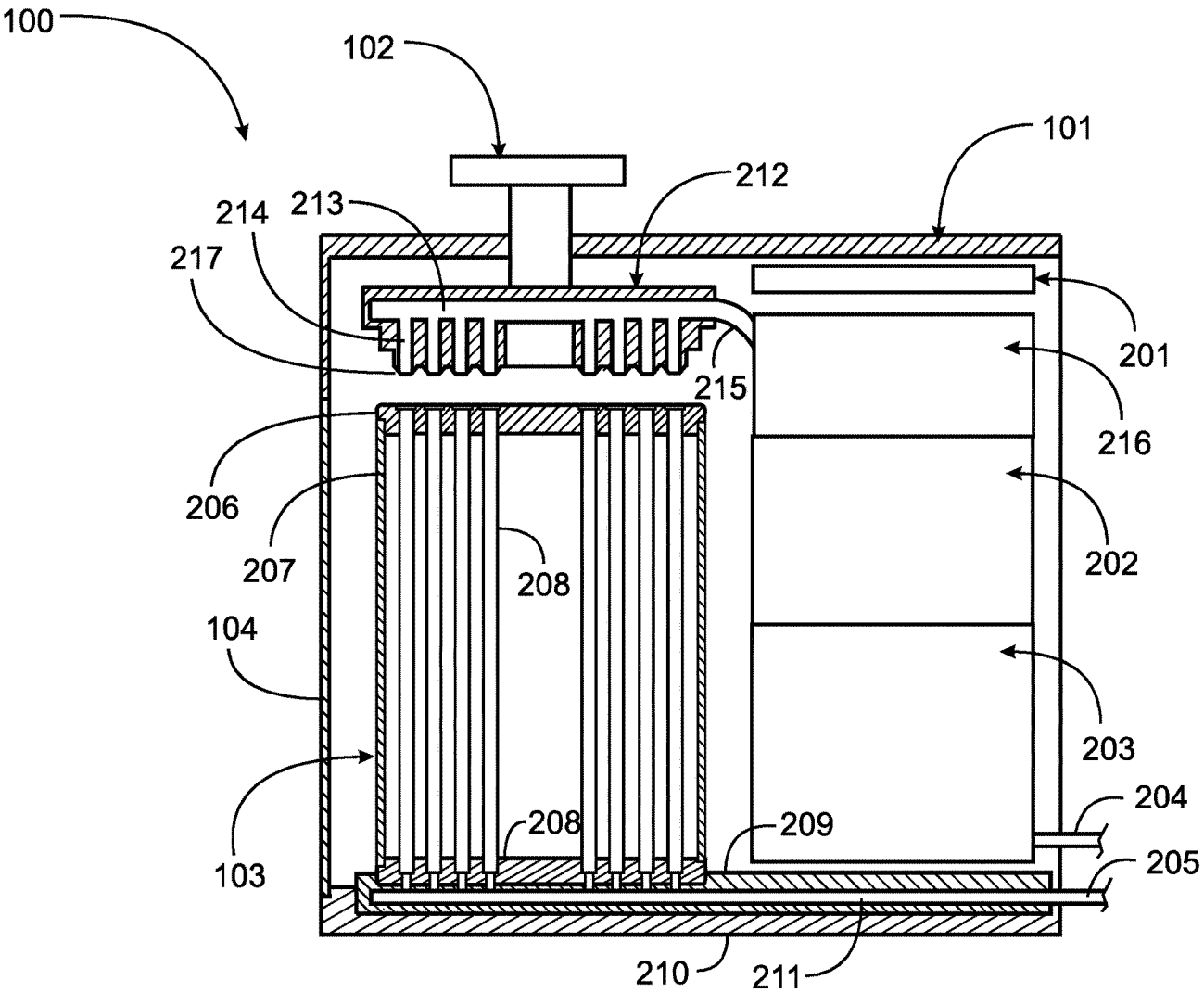
FIG. 2 is an elevation view of the apparatus of FIG. 1 in partial section view.

FIG. 2 is an elevation view of apparatus 100 of FIG. 1 in partial section view. Canister 103 is shown in section as comprising a top plate 206 and a bottom plate 208, separated by an outer cylindrical body 207. The plates and the body may be metal, such as aluminum, or of molded polymer materials. A plurality of tubes 218 extend from top plate 206 to bottom plate 208, and pass through both plates. These tubes in this example are arranged in a pattern through the upper and lower plates along radii as shown in FIG. 1, but this is simply a preference, and not limiting in the invention.

Each of tubes 218, of which there are forty in this example, has a length and a diameter sufficient to accommodate the length of most straws in the art, and each has a shoulder near the bottom of the tube, so the straw will not fall out the bottom of the tube when the canister is moved, but will still allow water to pass through the tube. In one embodiment, tubes 218 may be modular and replaced with tubes of differing diameters to accommodate larger or smaller diameter straws.

It may be seen in FIG. 2, in this example, that cleaning enclosure 101 has a lower manifold unit 209 supported by a base 210, that has an indenture into which the bottom of the canister may register, and in so registering, all tubes 218 are coupled to a passage 211, which has an exit conduit 205 from enclosure 101. An act of placing canister 103 into the indenture couples all tubes through the bottom of plate 208 to passages in the manifold unit. FIG. 2 depicts the canister in place and the door closed.

Enclosure 101 further comprises a manifold unit 212 as part of locking nozzle apparatus 102. Manifold unit 212 has internal passages 213, and descending passages 214, one nozzle 217 aligning with each tube 218 in canister 103. Internal passages 213 connect to an input conduit 215 from a water pump 216. Control inputs are provided as components of control electronics circuitry 201. In operation water pump 216 provides water through input conduit 215 to passages 213, hence to passages 214, nozzles 217 and to tubes 218. The water comes through a heater 202 from a water reservoir 203, which may be replenished from an input conduit 204.

Figure 3:
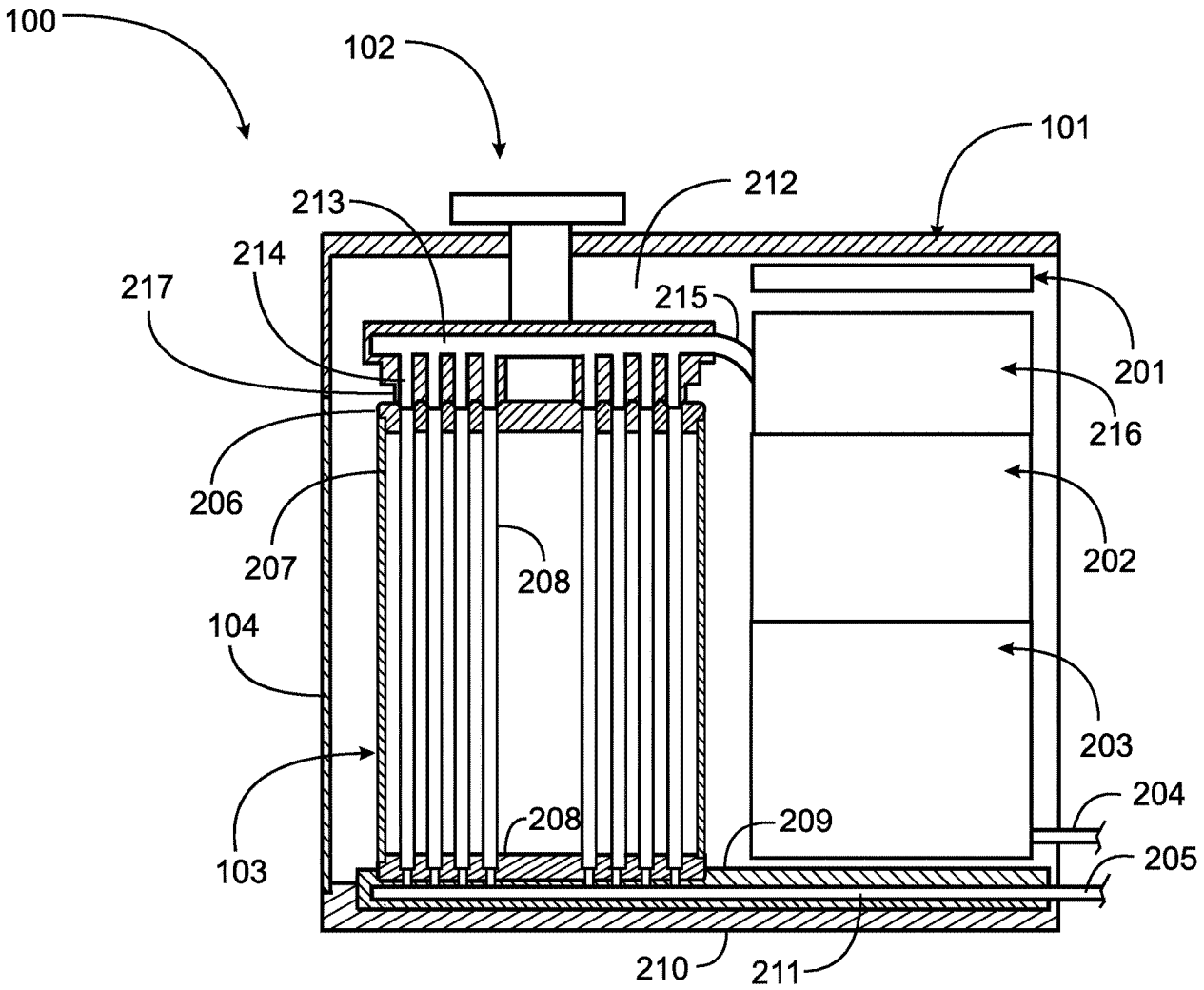
FIG. 3 is an elevation view of the apparatus of FIGS. 1 and 2, illustrating an alternative state.

FIG. 3 is an elevation view of the apparatus of FIGS. 1 and 2, also in partial section, illustrating an alternative state, in which locking nozzle apparatus 102 is lowered and locked down with nozzles 217 in contact with opening into each of tubes 218 in canister 103. In the state shown in FIG. 3 the cleaning system may be activated through control inputs as components of control electronics circuitry 201. There may be, for example, a toggle button that starts a cycle wherein water from tank 203 is drawn by pump 216 through heater 202 and passed through conduit 215 to passages 213 and 214 to tubes 218. With straws to be cleaned in tubes 218, the water, heated in some embodiments to at least 180 degrees Fahrenheit, passes over and around each of the straws and cleans and sanitizes the straws. An alternative embodiment provides a heating element within water reservoir 203, maintaining water at a set temperature of at least 180 degrees, or more. In this manner, all water utilized for cleaning straws enters the system at the proper temperature. Additionally, straws manufactured from materials not capable of enduring high temperature may be sanitized via chemical for example, bleach or other sanitizing chemical.

In some embodiments there may be a recirculation system wherein water passing through tubes 218 and out through passages 211 may go back into tank 203 to be reused. In other embodiments water passing through tubes 218 may exit via conduit 205, and only fresh water may be heated and drawn by pump 216.

In embodiments of the invention there be additives to the water that is used in sanitizing straws. For example, a low concentration of bleach may be added as a sanitizer, and other sanitizers may be used as well.

In some embodiments ultraviolet light may be used as a sanitizing process as well. In particular Ultraviolet germicidal irradiation (UVGI) may be implemented as a disinfection method that uses short-wavelength ultraviolet (UV-C) light to kill or inactivate microorganisms by destroying nucleic acids and disrupting their DNA, leaving them unable to perform vital cellular functions. Killing bacteria with UV light requires use of germicidal wavelengths of 185-254 nanometers (nm).

UV light may be used before or after, or before and after sanitizing with water base, by, for example, exposing straws to be sanitized supported on racks and exposed to UV-emitting devices.

Figure 4A:
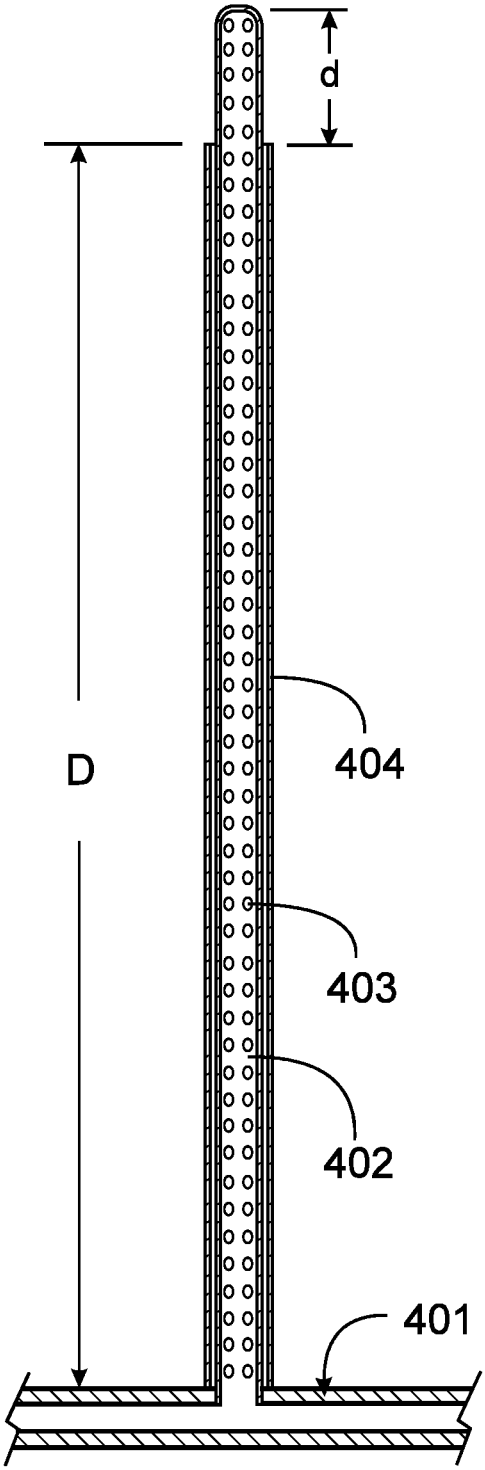
FIG. 4A is an elevation view of a water distribution tube of the invention.

In another aspect of the invention straws to be sanitized may be supported in a canister implemented considerably differently than canister 103 as seen in FIGS. 1, 2 and 3. FIG. 4A is an elevation view of a water distribution tube 402 with a pattern of openings 403 along the vertical length of the tube. In this example the openings are horizontal holes arranged in patterns of four, with one hole each at each height facing outward in directions separated by ninety degrees. Patterns of four are implemented along the height at intervals of, in one embodiment, about one-half inch. The diameters, number at each height, directions and spacing may differ in different embodiments.

It may be seen in FIG. 4A that tube 402 is rigidly engaged into a fluid manifold 401, such that fluid, water, for example, pumped into manifold 401 will be urged upward through tube 402, and horizontally out of openings 403. A straw 404 to be sanitized is placed over the tube, so water sprayed from holes 403 will impinge on the inner surface of the straw for the full height of the straw.

In one embodiment the height of straw 404 is dimension D. And in one embodiment the height of tube 402 is longer by dimension d. Dimension d may vary in different embodiments, but in some embodiments may be as much as two inches or more. The tube being longer than the straw exposes at least some holes 403 above the top of the straw. An important purpose of the extended height of the tube is that water pumped into the tube from manifold 401 will spray horizontally outward above the top of the straw. In some implementations of the invention a plurality of tubes are implemented in a pattern over a manifold to hold a plurality of straws to be sanitized, and water sprayed from the added height of the tube above the straws will serve to sanitize the outer surfaces of straws placed on the plurality of tubes.

Figure 4B:
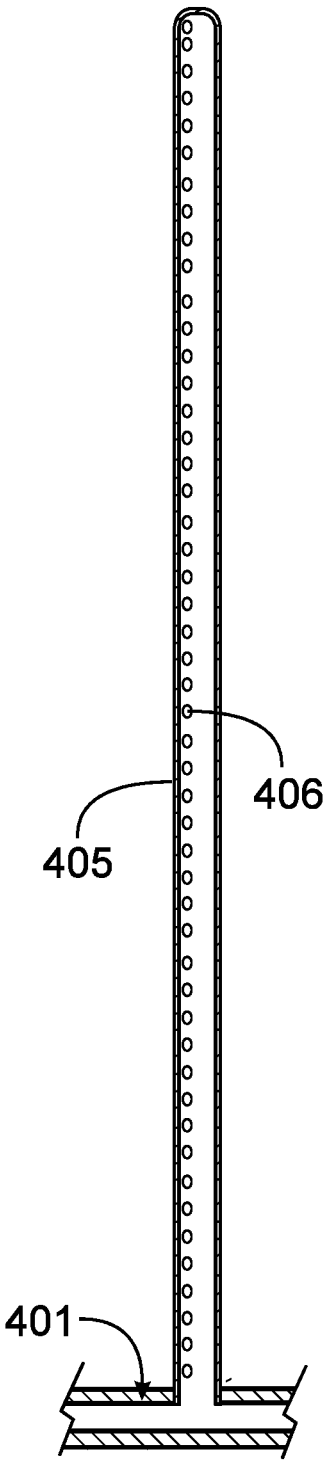
FIG. 4B is an elevation view of an alternative water distribution tube.

FIG. 4B is an elevation view of another tube 405 with horizontally-facing openings 406 at different heights vertically on the tube. In this example openings 406 are arranged in a single vertical row, so water sprayed from the tube will be directed all in the one horizontal direction that the vertical row of holes is directed. In other embodiments there may be two, three, four, or even more vertical rows of holes that may be directed in directions for specific purposes.

Figure 5A:
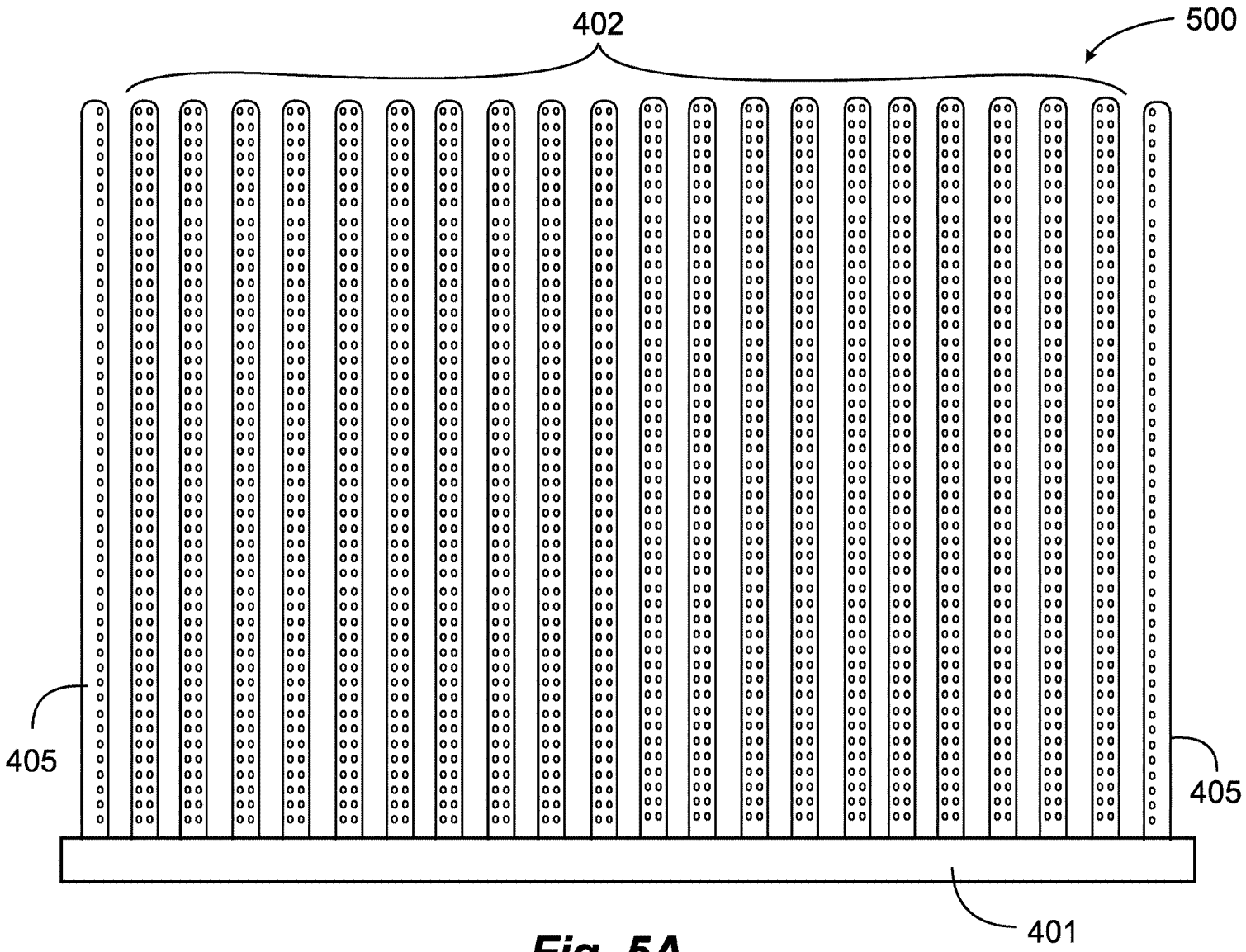
FIG. 5A is a side view of a canister in an alternative embodiment of the invention.
Figure 5B:
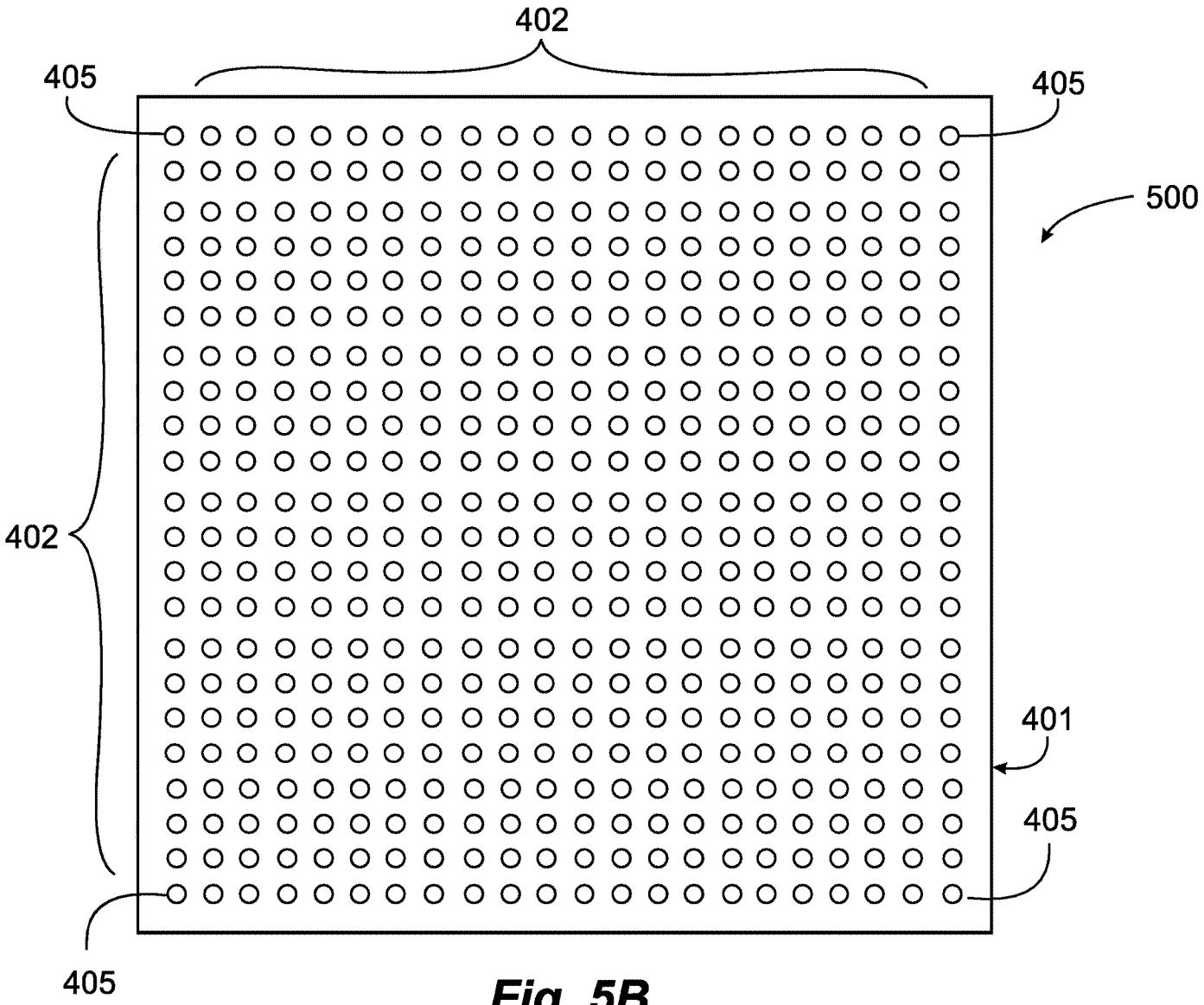
FIG. 5B is a plan view of the canister of FIG. 5A.

FIG. 5A is a side elevation view of a canister 500 comprising a manifold 501 having a plurality of tubes 402 and 405 arranged in a Cartesian matrix seen from above, as is shown in FIG. 5B.

FIG. 5B is a top plan view of canister 500 showing manifold 401 with a Cartesian matrix of 484 tubes equally spaced in twenty-two columns and twenty-two rows. In this example there are four corner tubes 405 in the matrix with directed spray back into the matrix of 480 tubes 402.

In one circumstance straws to be sanitized may be placed over all 400 tubes 402. Canister 500 may then be placed in an enclosure described below wherein connection of water flow may be made to manifold 401, and water may be pumped into tubes 402 and 405 through the manifold. Tubes 402 will spray water into the inside of the straws, and tubes 405 will spray water that may impact a majority of straws on the outside. Referring back to FIG. 4A, with the tubes longer than the straws, every tube will also spray water that will impinge neighboring straws on the outside. As an additional feature, straws may be loaded onto only a specific pattern of tubes, leaving a plurality of tubes in the matrix not covered by straws. The uncovered tubes will, in this circumstance spray water on the outside of neighboring straws.

Figure 6:
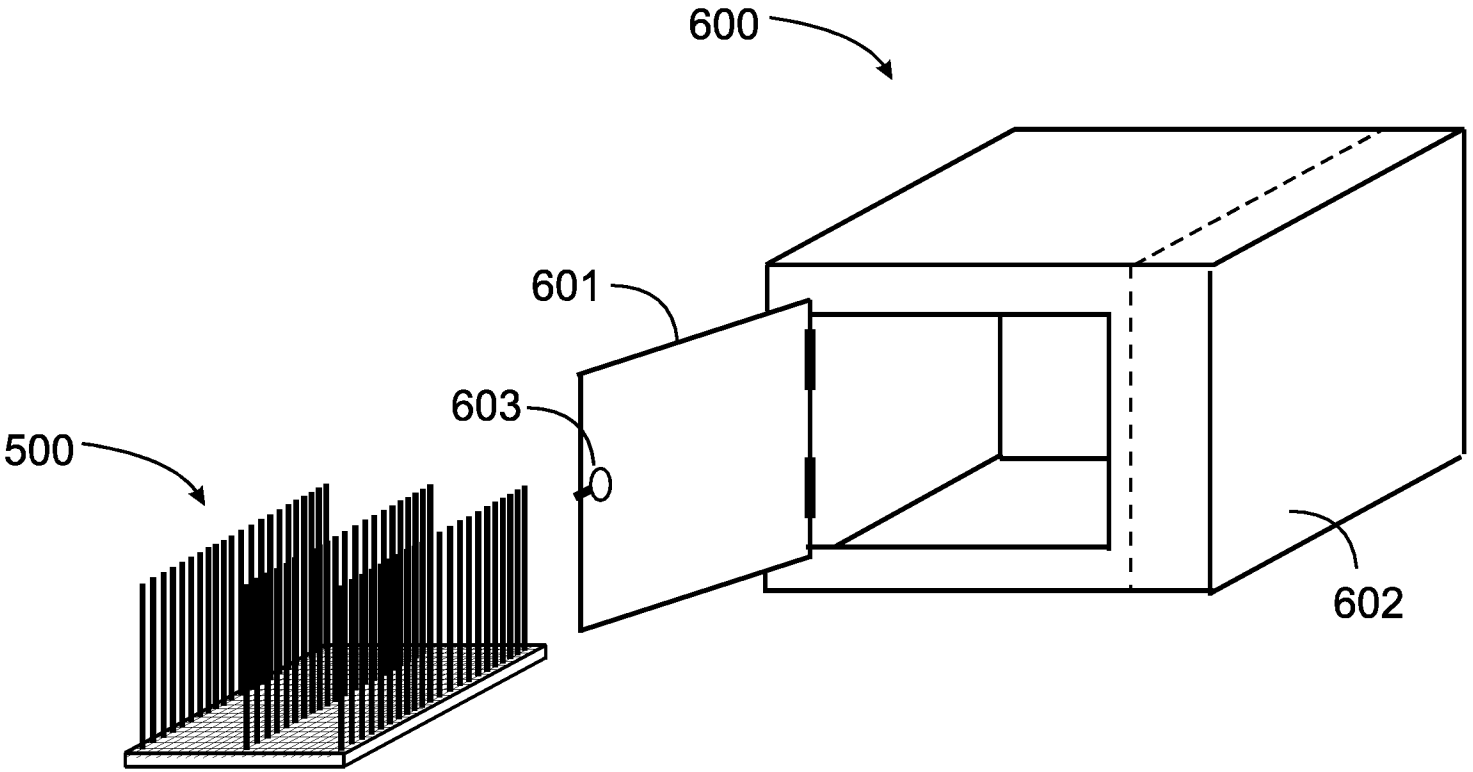
FIG. 6 is a perspective view of a canister and a cleaning enclosure in an alternative embodiment of the invention.

FIG. 6 is a perspective view of canister 500 adjacent an enclosure 600 having a door 601 with a latch 603. Canister 500 is shown with vertical tubes indicated as solid lines, and only in three of eleven rows, as showing all details would create confusion, and the canister is described above in enabling detail. Enclosure 600 has many details in common with cleaning enclosure 101 of FIG. 1, which is described in enabling detail above. Enclosure 600 has, for example, an interface for accepting and connecting to manifold 401 of canister 500, and providing heated water under pressure, as is described above. In the circumstance of enclosure 600, when the canister is placed inside, and interfaced with the manifold, water is provided by a pump from a reservoir through a heater in a region 602, much as described above for enclosure 101. When a cycle is completed, door 601 may be opened, canister 500 removed, and clean straws may be removed from canister 500 and straws to be cleaned may be loaded for a new cycle.

Figure 7:
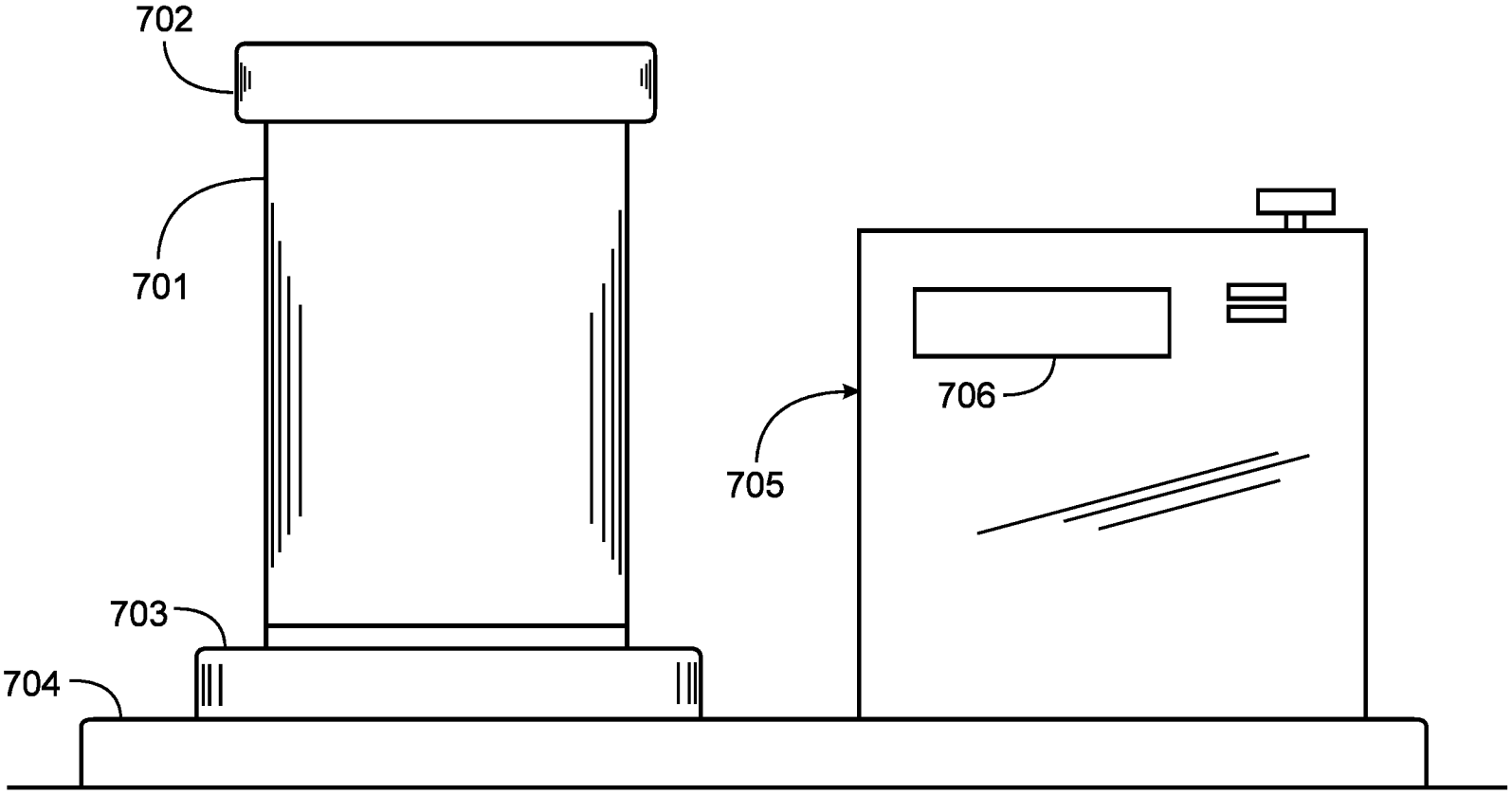
FIG. 7 is a plan view of an alternative embodiment of the invention.

Referring now back to FIGS. 2 and 3, which depict a canister 103 that is placed in a cleaning enclosure 101 to clean the straws, that embodiment is an example. FIG. 7 illustrates another embodiment in which canister 701 is essentially the same as canister 103 in FIGS. 2 and 3, but the functions of the cleaning enclosure are implemented differently. Canister 701 engages a pedestal 703 on a base unit 704. Pedestal 703 serves the function of manifold unit 209 of FIGS. 2 and 3, with internal passages delivering and returning heated water from a pump operating in a side enclosure 705, which houses the pump and water heater and reservoir as are described above in reference to FIG. 3.

In this example side enclosure 705 comprises a display 706 that may indicate status of a cleaning cycle, water temperature and other data. In operation a user may open lid 702, exposing tubes in canister 701 wherein straws to be cleaned may be inserted. The lid may then be replaced and a cleaning cycle initiated. When the cleaning cycle is complete the user may disengage the canister from pedestal 703, and perhaps engage another canister with straws already loaded. In another embodiment the canister may be designed such that the tubes are short enough that the straws extend far enough above the tubes that the cleaned straws may be removed without disengaging canister 701 from pedestal 703.

Referring now back to FIGS. 3, 4A and B and 5A and B, the skilled person will realize that there are two essentially different implementations of canisters, one in which straws are placed in tubes, and another in which straws are placed over tubes. Canister 701 may be implemented as either type.

The person with skill in the art will understand that the descriptions of embodiments of the present invention described above are entirely exemplary, and not meant to be limiting to the scope of the invention. Many of the elements and inter-relationships of elements described may be accomplished in different ways within the scope of the invention. It was already described above that the pattern of tubes in the canister may take different forms than that shown in FIG. 1. The number of tubes may also vary, and just about every element may be accomplished differently within the scope of the invention. The canister, for example, may be placed into the cleaning enclosure in a horizontal orientation, and the cleaning enclosure may be designed to accept the horizontal canister. There are many other variations within the scope of the invention. The invention is limited only by the scope of the claims.

I claim:

1. An apparatus for cleaning drinking straws, comprising:

a housing enclosing a plurality of vertical carriers for supporting tubular drinking straws having an open bottom end and an open top end;

a vertically translatable nozzle apparatus positioned above the carriers, having an individual nozzle aligned with each open top end; and a subsystem supplying water heated to a sanitizing temperature to the nozzle apparatus;

wherein the drinking straws are placed on the carriers through the bottom opening of the straw with a top portion of the carrier extending out the open top ends of the tubular drinking straws, and the translatable nozzle is positioned, one each of the nozzles engaging with each one of the carriers enabling the heated water to flow around the inside and the outside of each one of the straws.

2. The apparatus of claim 1 wherein the carriers are tubes, each of a length and diameter to enclose a straw to be cleaned, and the heated water flows through the tubes immersing the straws.

3. The apparatus of claim 1 wherein the carriers are upright tubes of a diameter less than a diameter of straws to be cleaned, each upright tube having horizontally-directed openings, and wherein the straws to be cleaned are placed over the tubes and the heated water flows into the tubes, flows down the outside of the tubes from the top portion of the carrier and out through the horizontally-directed openings.

4. The apparatus of claim 1 further comprising a pump and heater implemented proximate a canister removably connected within the housing and enabled to enclose the carriers, such that heated water is pumped via the nozzle apparatus through the carriers and either directed to a drain or re-circulated to the pump and heater.

5. The apparatus of claim 4 further comprising an enclosure having physical interfaces for the manifolds to connect to the canister and carriers, and a door to the enclosure, such that canisters are removable and replaceable in the enclosure, straws being placed in or on the carriers outside the enclosure, and cleaning happening inside the enclosure.

6. The apparatus of claim 5 wherein a physical interface couples a base of the canister to a fluid conduit, wherein loading a canister involves positioning the nozzle apparatus, coupling the nozzles to each of the tubes, such that heated water is pumped downward through the tubes, enveloping the straws in the tubes, and out through the fluid conduit at the base of the canister.

7. The apparatus of claim 4 wherein the canister is of rectangular shape, and a plurality of the tubes are arranged vertically from the base in a Cartesian pattern.

8. The apparatus of claim 7 wherein, when the canister is loaded into the cleaning enclosure, the base of the canister is coupled to a fluid entrance conduit, such that heated water is pumped upward through the tubes, spraying water against the inside surfaces of the straws mounted over the tubes, and water is also sprayed above the straws onto the outside surfaces of the straws.

9. The apparatus of claim 1 further comprising sanitizing additives in the heated water.

10. The apparatus of claim 1 further comprising ultra violet (UV) irradiation apparatus and support apparatus for straws to be cleaned, wherein straws are placed on the support apparatus and irradiated by UV light before or after, or before and after being cleaned by heated water in the cleaning enclosure.

* * * * *